US007866275B2

(12) United States Patent
Schmidt, Jr.

(10) Patent No.: US 7,866,275 B2
(45) Date of Patent: Jan. 11, 2011

(54) RETRACTABLE PLATFORM FOR TRANSOM OF BOAT

(75) Inventor: Anthony P. Schmidt, Jr., West Branch, MI (US)

(73) Assignee: Chareyl Schmidt, West Branch, MI (US), part interest ( * ) Notice: Subject to any disclaimer, the term of this patent is extended or adjusted under 35 U.S.C. 154(b) by 166 days.

(21) Appl. No.: 12/290,696

(22) Filed: Nov. 3, 2008

(65) Prior Publication Data

US 2010/0107960 A1 May 6, 2010

(51) Int. Cl.
*B63B 17/00* (2006.01)
*B63C 1/02* (2006.01)

(52) U.S. Cl. ..... 114/362; 114/48

(58) Field of Classification Search ..... 114/365, 114/368, 369, 343, 354, 362, 48
See application file for complete search history.

(56) References Cited

U.S. PATENT DOCUMENTS 6,003,463 A * 12/1999 Giesler ..... 114/259
6,047,659 A * 4/2000 Schmidt, Jr. ..... 114/369
6,786,170 B2 * 9/2004 Trowbridge ..... 114/259

* cited by examiner

*Primary Examiner*—Daniel V Venne

(57) ABSTRACT

A movable platform for attachment to a transom of a boat is disclosed. The movable platform includes a planar platform disposed horizontally and a planar frame coupled to an underside of the platform. The movable platform further includes at least one elongated tube coupled to the transom of the boat, wherein at least one element of the planar frame is movably disposed within the at least one elongated tube. The movable platform further includes at least one cylinder disposed horizontally, wherein a barrel of the at least one cylinder is secured to the at least one elongated tube and wherein a piston rod of the at least one cylinder is secured to the planar frame, such that the planar frame is moved horizontally when the piston rod moves within the barrel.

20 Claims, 3 Drawing Sheets

RETRACTABLE PLATFORM FOR TRANSOM OF BOAT

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of marine devices, and more particularly relates to the field of lift devices with platforms for boat transoms.

BACKGROUND OF THE INVENTION

A platform coupled to a lifting device on the transom of a boat can be used as a swimming platform, which is lowered into or close to the water line during use, or for lifting small crafts, such as a personal watercraft or a dinghy, into and out of the water. Such apparatus provide convenience to users that desire a swimming platform that can be lowered into the water for use when the boat is anchored or docked and that can be retracted out of the water when the boat is moving or in operation. Such devices are further convenient because they allow users to secure a small watercraft onto the platform, to extend the platform into the water for use of the small watercraft and then to retract the platform out of the water when use of the small watercraft is complete. Various conventional lifting devices with platforms for boat transoms are available. But conventional devices of this type are not without their drawbacks.

Conventional lifting devices with platforms for boat transoms normally only provide lift in the upwards or downwards directions. U.S. Pat. Nos. 4,878,450 and 5,544,606 are examples of such conventional lifting devices with platforms. Though these devices may satisfy the desire of users to lift a platform into and out of the water, they do not satisfy the desire of users to move a platform in other directions. Therefore, having only two degrees of freedom limits the versatility of conventional lifting devices with platforms.

Therefore, a need exists to overcome the problems with the prior art as discussed above, and particularly for a lifting device with a platform for a boat transom that provides additional degrees of freedom in its movement.

SUMMARY OF THE INVENTION

Briefly, according to an embodiment of the present invention, a movable platform for attachment to a transom of a boat is disclosed. The movable platform includes a planar platform disposed horizontally and a planar frame coupled to an underside of the platform. The movable platform further includes at least one elongated tube coupled to the transom of the boat, wherein at least one element of the planar frame is movably disposed within the at least one elongated tube. The movable platform further includes at least one cylinder disposed horizontally, wherein a barrel of the at least one cylinder is secured to the at least one elongated tube and wherein a piston rod of the at least one cylinder is secured to the planar frame, such that the planar frame is moved horizontally when the piston rod moves within the barrel.

In another embodiment of the present invention, a lifting device for attachment to a transom of a boat is disclosed. The lifting device includes a planar platform disposed horizontally and a planar frame coupled to an underside of the platform. The lifting device further includes at least one elongated tube coupled to the transom of the boat, wherein at least one element of the planar frame is movably disposed within the at least one elongated tube. The lifting device further includes at least one cylinder disposed horizontally, wherein a barrel of the at least one cylinder is secured to the at least one elongated tube and wherein a piston rod of the at least one cylinder is secured to the planar frame, such that the planar frame is moved horizontally when the piston rod moves within the barrel. The lifting device further includes a lift assembly coupled to the transom of the boat, wherein the lift assembly is coupled to the at least one elongated tube and wherein the lift assembly moves the at least one elongated tube in a vertical direction.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

The present invention solves problems with the prior art by providing a movable platform that provides additional degrees of freedom of movement of the platform. The apparatus of the present invention provides movement of the movable platform in the forwards and backwards directions in addition to the upwards and downwards directions. Thus, in addition to providing movement of the movable platform into and out of the water, the movable platform can also be moved towards and away from the transom of the boat. This additional degree of movement provides convenience to users that desire to move the platform away from the boat when docking a personal watercraft and to move the platform towards the boat when docking is complete. This additional degree of movement further provides convenience to users that desire assistance when docking a watercraft, such that the location of the platform may be adjusted during docking so as to accommodate the location of the watercraft in the water.

Furthermore, the present invention solves the problem associated with the clearance distance needed during lifting and lowering of a platform. A lifting device of this type requires that the platform be located a minimum distance from the transom of the boat during lifting and lowering of the platform so that the platform does not contact the transom or other elements of the lifting device. The present invention allows such a clearance distance to be in place during lifting and lowering of the platform while still allowing the platform to be brought closer to the transom when lifting and lowering of the platform is complete.

Figure 1:
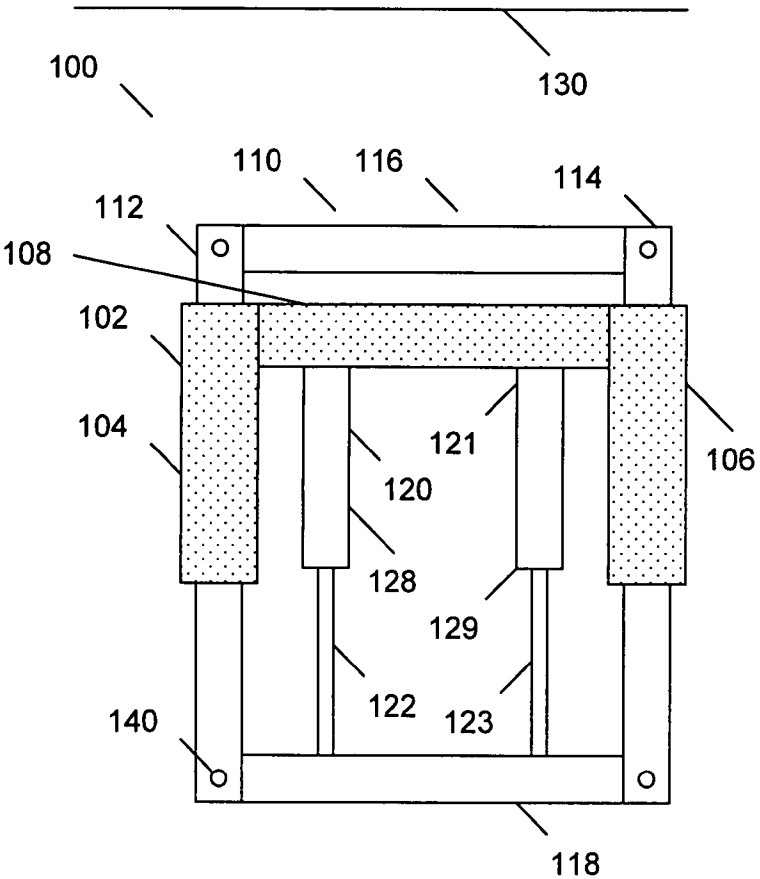
FIG. 1 is an illustration of a top view of the lifting device when the cylinders are extended, in accordance with one embodiment of the present invention.

FIG. 1 is an illustration of a top view of the lifting device 100 when the cylinders 128, 129 are extended, in accordance with one embodiment of the present invention. FIG. 1 shows that the lifting device 100 comprises a roughly U-shaped structure 102. The structure 102 comprises two parallel tubes 104, 106 that are arranged in a horizontal direction and parallel to the major axis of the boat. Each parallel tube 104, 106 can have a rectangular cross-section, a circular cross-section or the like. Connecting the parallel tubes 104, 106 is the rigid bar 108 that is arranged in a horizontal direction and perpendicular to the major axis of the boat and the parallel tubes 104, 106.

FIG. 1 further shows that the lifting device 100 comprises a roughly rectangular-shaped frame 110. The frame 110 comprises two parallel bars 112, 114 that are arranged in a horizontal direction and parallel to the major axis of the boat. Each parallel bar 112, 114 can have a rectangular cross-section, a circular cross-section or the like. Connecting the parallel bars 112, 114 along the top ends is the rigid bar 116 that is arranged in a horizontal direction and perpendicular to the major axis of the boat and the parallel bars 112, 114. Connecting the parallel bars 112, 114 along the bottom ends is the rigid bar 118 that is arranged in a horizontal direction and perpendicular to the major axis of the boat and the parallel bars 112, 114. Rigid bar 116 is parallel to rigid bar 118.

Situated on each corner of the rectangular frame 110 is a welding plate 140 on which a movable platform (not shown) is coupled. In one embodiment, portions of the movable platform are welded to the welding plates 140 of rectangular frame 110 so as to securely couple the movable platform to the rectangular frame 110.

Parallel bars 112, 114 are movably situated within the parallel tubes 104, 106 such that at least a portion of the parallel bars 112, 114 extends out of the parallel tubes 104, 106 while at least a portion of the parallel bars 112, 114 remains within the parallel tubes 104, 106. The parallel bars 112, 114 may slide or move within parallel tubes 104, 106 depending on the state of the cylinders 128, 129. In one embodiment, ball bearings, wheels or other friction-eliminating devices can be disposed within the point of junction between parallel bars 112, 114 and parallel tubes 104, 106 so as to facilitate movement of the parallel bars 112, 114 within the parallel tubes 104, 106.

FIG. 1 further shows cylinders 128, 129 that comprise barrels 120, 121, respectively, and pistons 122, 123, respectively. The barrels 120, 121 are securely coupled to the rigid bar 108 on one end. The pistons 122, 123 extend out of the other end of the barrels 120, 121. The pistons 122, 123 are securely coupled on one end to the rigid bar 118. FIG. 1 shows the cylinders 128, 129 in an extended state as the pistons 122, 123 are shown extended outwards. As the pistons extend outwards and away from the transom 130 of the boat, the parallel bars 112, 114 move accordingly within the parallel tubes 104, 106 (which remain stationary). As such, the frame 110 is shown moved away from the transom 130 of the boat. Cylinders 128, 129 may be oil-based hydraulic cylinders activated via an oil line, pneumatic cylinders activated via a pump or an air line or electric cylinders activated via a power line.

Figure 2:
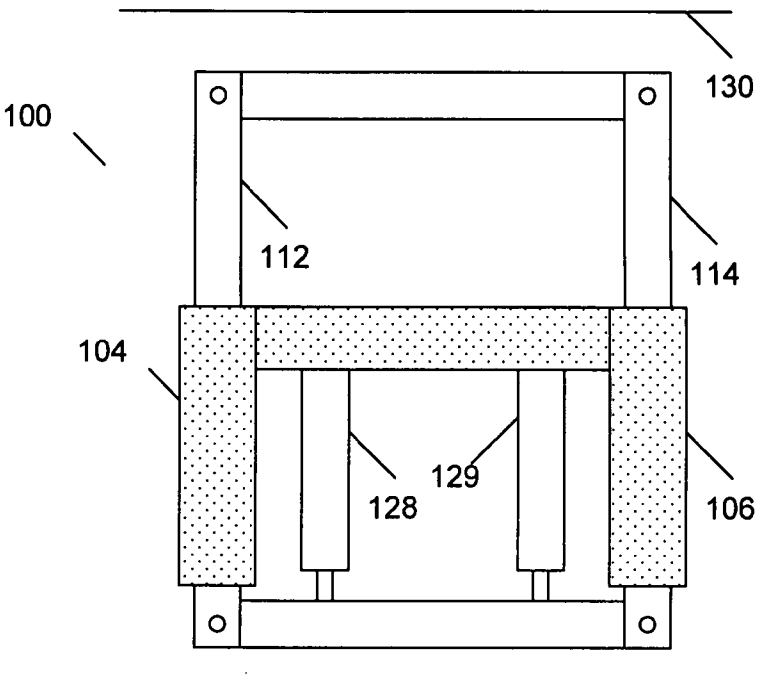
FIG. 2 is an illustration of a top view of the lifting device when the cylinders are retracted, in accordance with one embodiment of the present invention.

FIG. 2 is an illustration of a top view of the lifting device 100 when the cylinders 128, 129 are retracted, in accordance with one embodiment of the present invention. FIG. 2 shows the cylinders 128, 129 in a retracted state as the pistons 122, 123 are shown retracted inwards. As the pistons move inwards and toward the transom 130 of the boat, the parallel bars 112, 114 move accordingly within the parallel tubes 104, 106 (which remain stationary). As such, the frame 110 is shown moved toward the transom 130 of the boat.

Figure 3:
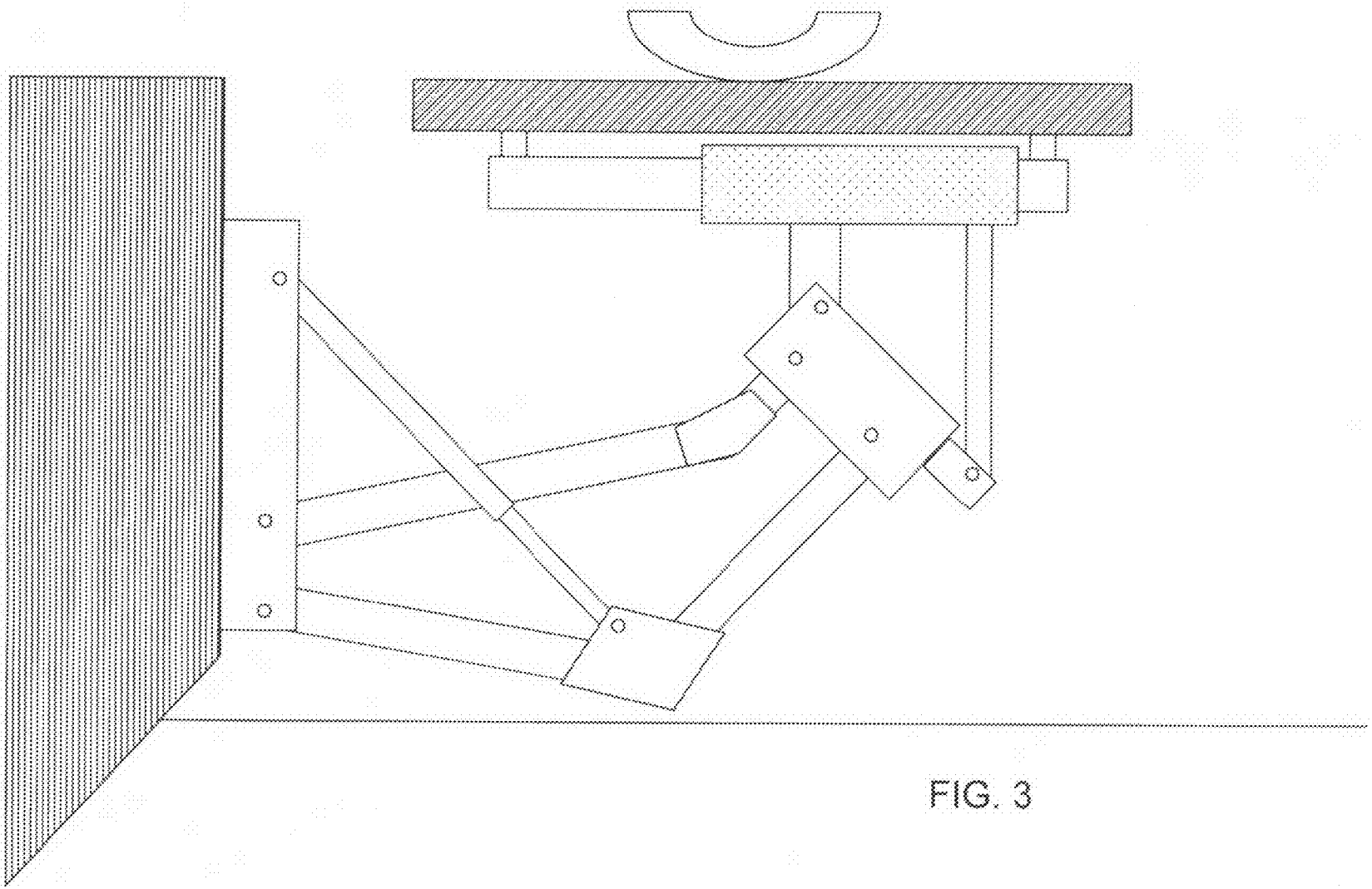
FIG. 3 is an illustration of a side view of the lifting device when the platform is raised, in accordance with one embodiment of the present invention.

FIG. 3 is an illustration of a side view of the lifting device 100 when the platform 302 is raised above the water line 350, in accordance with one embodiment of the present invention. FIG. 3 shows a platform 302 on which a fastener 301 for fastening a watercraft is situated. FIG. 3 further shows that the lifting device 100 comprises a lifting assembly 300 that is attached to the transom 130 of a boat via a mount 304. The lifting assembly 300 comprises a first lower arm 306 pivotally coupled to the mount 304 at pivot 312. The first lower arm 306 is immovably coupled with second lower arm 308 via welding plate 310. The lifting assembly 300 further comprises a first upper arm 316 pivotally coupled to the mount 304 at pivot 322. The first upper arm 316 is immovably coupled with second upper arm 318 via welding plate 320.

One end of second lower arm 308 is pivotally coupled to the box 330 at pivot 332 while one end of second upper arm 318 is pivotally coupled to the box 330 at pivot 334. One end of vertical support 340 is pivotally coupled to the box 330 at pivot 344 while the other end of vertical support 340 is coupled to parallel tube 106. One end of vertical support 342 is pivotally coupled to the box 330 at pivot 346 while the other end of vertical support 342 is coupled to parallel tube 106. The frame 110 consisting of parallel bar 114 is in the retracted position (as in FIG. 2) thereby placing the attached platform 302 (attached to frame 100 via welding plates 140) as close to the transom 130 as possible.

FIG. 3 further shows that the lifting assembly 300 includes a cylinder 360 consisting of a barrel 362 pivotally coupled to the mount 304 at pivot 366 and of a piston 362 pivotally coupled to the welding plate 310 at pivot 368. In FIG. 3, the piston 364 is retracted and therefore the lifting assembly 300 and the platform 302 are above the water line 350. Cylinder 360 may be an oil-based hydraulic cylinder activated via an oil line, a pneumatic cylinder activated via a pump or an air line or an electric cylinder activated via a power line.

Figure 4:
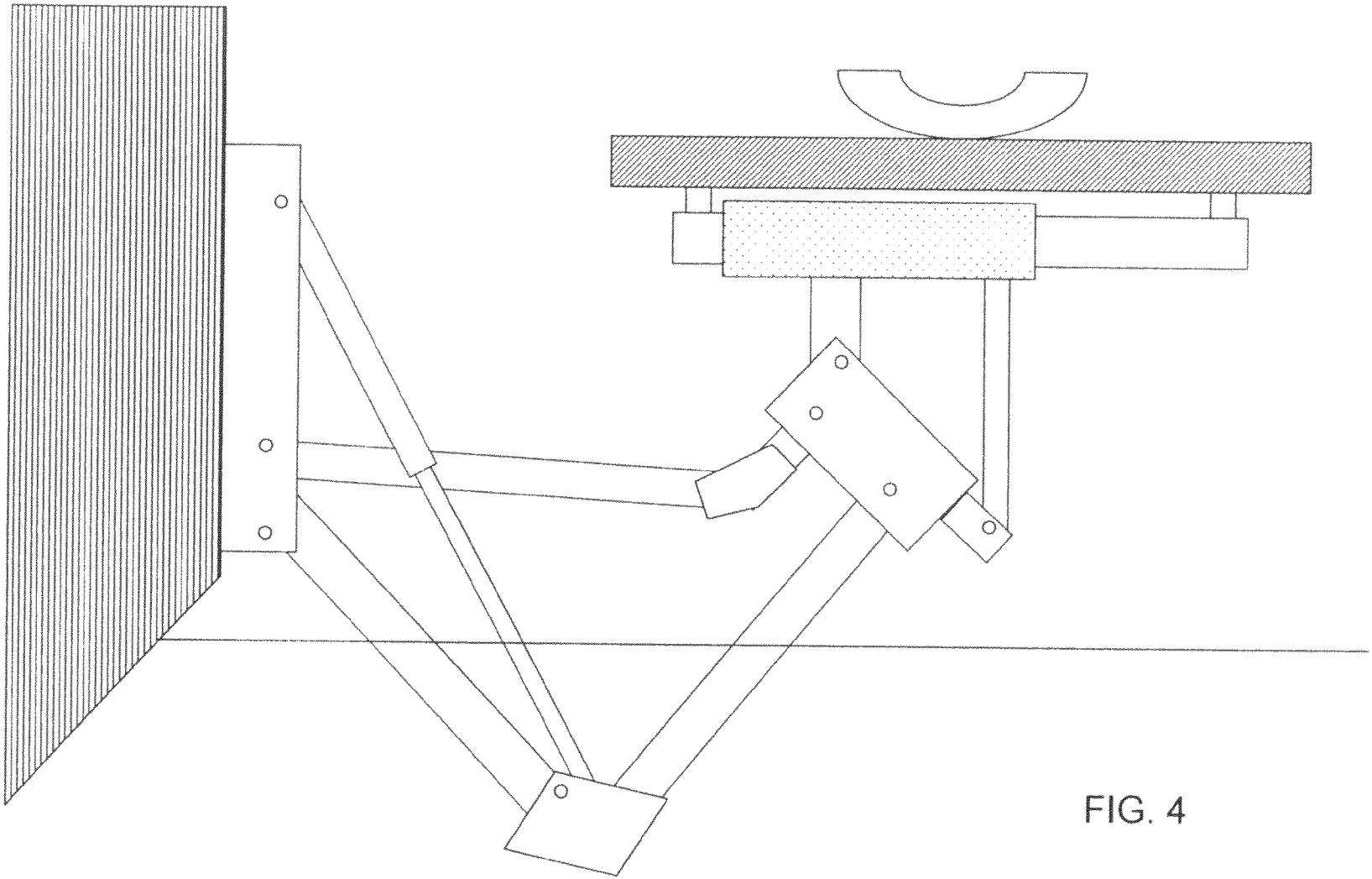
FIG. 4 is an illustration of a side view of the lifting device while the platform is being lowered, in accordance with one embodiment of the present invention.

FIG. 4 is an illustration of a side view of the lifting device 100 while the platform 302 is being lowered below the water line 350, in accordance with one embodiment of the present invention. As piston 362 extends, arm 316 pivots about pivot 322 as is lowers into the water and arm 306 pivots about pivot 312 as is lowers into the water. Likewise, cylinder 360 pivots about pivot 366 as it rotates downwards. As piston 362 extends, the lower arms 306, 308, as well as the upper arms 316, 318 begin to lower towards the water line 350. As this occurs, the box 330 is lowered into the water as the arm 318 pivots about pivot 334 and arm 308 pivots around pivot 332. Further, as box 330 lowers towards the water, arm 340 pivots around pivot 344 and arm 342 pivots around pivot 346. In this matter, box 330 so as to maintain the horizontal disposition of structure 102 and, by extension, platform 302.

The frame 110 consisting of parallel bar 114 is in the extended position (as in FIG. 1) thereby placing the attached platform 302 (attached to frame 100 via welding plates 140) as far from the transom 130 as possible, so as to accommodate the distance clearance necessary during lowering of the platform 302.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. A movable platform for attachment to a transom of a boat, comprising:

a planar platform disposed horizontally;

a frame coupled to an underside of the platform;

at least one elongated tube coupled to the transom of the boat, wherein at least one element of the frame is movably disposed within the at least one elongated tube; and at least one cylinder disposed horizontally, wherein a barrel of the at least one cylinder is secured to the at least one elongated tube and wherein a piston rod of the at least one cylinder is secured to the frame, such that the frame is moved horizontally when the piston rod moves within the barrel.

2. The retractable platform of claim 1, wherein the planar platform further comprises a top surface including a fastener for securing a watercraft onto the planar platform.

3. The retractable platform of claim 2, wherein the frame comprises a pair of elongated elements disposed horizontally and parallel to a major axis of the boat.

4. The retractable platform of claim 3, wherein the frame comprises a rigid elongated element that couples the pair of elongated elements, wherein the rigid elongated element is disposed horizontally and perpendicular to a major axis of the boat.

5. The retractable platform of claim 4, wherein the piston rod of the at least one cylinder is secured to the rigid elongated element.

6. The retractable platform of claim 5, wherein the frame comprises at least one welding plate that connects the frame to the planar platform.

7. The retractable platform of claim 6, wherein the at least one elongated tube comprises a pair of elongated tubes disposed horizontally and parallel to a major axis of the boat.

8. The retractable platform of claim 7, wherein the at least one elongated tube further comprises a second rigid elongated element that couples the pair of elongated tubes, wherein the second rigid elongated element is disposed horizontally and perpendicular to a major axis of the boat.

9. The retractable platform of claim 8, wherein the barrel of the at least one cylinder is secured to the second rigid elongated element.

10. The retractable platform of claim 9, wherein at least a portion of the pair of elongated elements is movably disposed within the pair of elongated tubes.

11. A lifting device for attachment to a transom of a boat, comprising:

a planar platform disposed horizontally;

a frame coupled to an underside of the platform;

at least one elongated tube, wherein at least one element of the frame is movably disposed within the at least one elongated tube;

at least one cylinder disposed horizontally, wherein a barrel of the at least one cylinder is secured to the at least one elongated tube and wherein a piston rod of the at least one cylinder is secured to the frame, such that the frame is moved horizontally when the piston rod moves within the barrel; and a lift assembly coupled to the transom of the boat, wherein the lift assembly is coupled to the at least one elongated tube and wherein the lift assembly moves the at least one elongated tube in a vertical direction.

12. The lifting device of claim 11, wherein the planar platform further comprises a top surface including a fastener for securing a watercraft onto the planar platform.

13. The lifting device of claim 12, wherein the frame comprises a pair of elongated elements disposed horizontally and parallel to a major axis of the boat.

14. The lifting device of claim 13, wherein the frame comprises a rigid elongated element that couples the pair of elongated elements, wherein the rigid elongated element is disposed horizontally and perpendicular to a major axis of the boat.

15. The lifting device of claim 14, wherein the piston rod of the at least one cylinder is secured to the rigid elongated element.

16. The lifting device of claim 15, wherein the frame comprises at least one welding plate that connects the frame to the planar platform.

17. The lifting device of claim 16, wherein the at least one elongated tube comprises a pair of elongated tubes disposed horizontally and parallel to a major axis of the boat.

18. The lifting device of claim 17, wherein the at least one elongated tube further comprises a second rigid elongated element that couples the pair of elongated tubes, wherein the second rigid elongated element is disposed horizontally and perpendicular to a major axis of the boat.

19. The lifting device of claim 18, wherein the barrel of the at least one cylinder is secured to the second rigid elongated element.

20. The lifting device of claim 19, wherein at least a portion of the pair of elongated elements is movably disposed within the pair of elongated tubes.

* * * * *